US011277678B2

(12) United States Patent
Eva

(10) Patent No.: US 11,277,678 B2
(45) Date of Patent: Mar. 15, 2022

(54) HANDLE ASSEMBLY FOR ELECTRONIC DEVICE

(71) Applicant: Bose Corporation, Framingham, MA (US)

(72) Inventor: Brenton Harry Eva, Fayette, ME (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/691,159

(22) Filed: Nov. 21, 2019

(65) Prior Publication Data

US 2021/0160601 A1 May 27, 2021

(51) Int. Cl.
*H04R 1/02* (2006.01)

(52) U.S. Cl.
CPC ..... *H04R 1/026* (2013.01); *H04R 1/025* (2013.01); *H04R 2201/029* (2013.01)

(58) Field of Classification Search
CPC ..... H04R 2420/07; H04R 5/02; H04R 1/023; H04R 1/028; H04R 2420/09; H04R 1/025; H04R 2201/028; H04R 2225/021; H04R 2225/0213; H04R 2225/025; H04R 2460/11; H04R 25/556; H04R 25/60; H04R 25/652; H04R 25/658; H04R 3/12; H04R 5/04; H04R 19/013; H04R 1/026; H04R 1/1016; H04R 1/24; H04R 1/2811; H04R 1/2857; H04R 1/342; H04R 1/403; H04R 1/44; H04R 2201/025; H04R 2201/029; H04R 2201/403; H04R 2209/022; H04R 2227/003; H04R 2499/11; H04R 2499/13; H04R 2499/15; H04R 5/023; H04R 9/025; H04R 9/063; H04M 2250/12; H04M 3/5116; H04S 2400/01; H04S 2400/03; H04S 2400/11; H04S 2400/13; H04S 3/002; H04S 3/008; H04S 7/301; H04S 7/303; H04S 7/308; H04W 52/02; H04W 52/0229; H04W 52/0235; H04W 52/0296; H04W 84/18
USPC ..... 381/334, 14–109, 332, 333
See application file for complete search history.

(56) References Cited

U.S. PATENT DOCUMENTS 6,061,547 A * 5/2000 Ikebe ..... H04B 7/18515 455/12.1
8,515,092 B2 * 8/2013 Rucker ..... A63H 3/28 381/87
9,574,762 B1 * 2/2017 Grillo ..... F21V 15/01
D864,466 S * 10/2019 Romano ..... D26/138
D918,742 S * 5/2021 Feng ..... D10/6
(Continued)

*Primary Examiner* — Lun-See Lao

(57) ABSTRACT

A handle assembly for an electronic device, such as an audio device, is described herein. In some implementations, the handle assembly includes a flexible fabric, rope handle that attaches at the side and near the top of the device. The attachment assembly utilizes an eyelet that slides onto the rope handle prior to attaching an endpiece to the rope. The endpiece is inserted into a device housing opening that receives the handle attachment assembly. The eyelet is then inserted into that housing opening to secure the eyelet and endpiece into the opening. A sealing member, such as an O-ring, is utilized to secure the eyelet into the opening, and to provide other benefits, such as preventing or reducing acoustic buzz that would otherwise occur between the eyelet and the casing during audio playback.

20 Claims, 6 Drawing Sheets

(56) References Cited

U.S. PATENT DOCUMENTS

2005/0254678 A1* 11/2005 Wearing ..... H04R 5/02
381/334
2008/0252118 A1* 10/2008 Chang ..... B60R 11/0235
297/217.3
2014/0221178 A1* 8/2014 Wagner ..... A63B 21/00043
482/126
2015/0163607 A1* 6/2015 Harte ..... H04R 25/658
381/322
2015/0271583 A1* 9/2015 Wan ..... B05B 1/18
239/289
2018/0288525 A1* 10/2018 Katz ..... H04R 1/345

* cited by examiner

HANDLE ASSEMBLY FOR ELECTRONIC DEVICE

BACKGROUND

This disclosure relates to a handle assembly for an electronic device, such as an audio device.

SUMMARY

All examples and features mentioned below can be combined in any technically possible way.

In one aspect, an audio device includes: a housing; and a handle assembly connected to the housing, the handle assembly including an eyelet in contact with the housing, a handle extending through at least a portion of the eyelet, an endpiece attached to an end of the handle, and a sealing member in contact with the eyelet and the housing.

Examples may include one of the following features, or any combination thereof.

In some examples, the sealing member forces the eyelet and the housing together at a location where the eyelet is in contact with the housing.

In some examples, the sealing member effectively prevents the eyelet from disconnecting from the housing.

In some examples, the sealing member reduces the handle assembly from causing undesired acoustic buzz during playback.

In some examples, the sealing member is an O-ring.

In some examples, the sealing member sits in a groove in the eyelet.

In some examples, a portion of the endpiece sits in a portion of the eyelet, such that the portion of the eyelet surrounds the portion of the endpiece.

In some examples, the eyelet is in contact with the housing at a lip of the housing, such that an outside surface of the eyelet is flush with an outside surface of the housing.

In some examples, the audio device further includes an acoustic enclosure, wherein the endpiece is rotatably engaged with the acoustic enclosure.

In some examples, one of the eyelet or the housing includes a first mating structure that engages with a second mating structure of the other of the eyelet or the housing to prevent rotation of the eyelet relative to the acoustic enclosure.

In some such examples, the first mating structure is a tooth and the second mating structure is a notch.

In some examples, the handle is constructed of fabric.

In some examples, the endpiece is integral with the handle.

In some examples, the handle assembly further includes another eyelet in contact with the housing, the handle extending through at least a portion of the other eyelet, another endpiece attached to the other end of the handle, and another sealing member in contact with the other eyelet and the housing.

In some examples, the audio device further includes one or more electro-acoustic drivers within the housing.

In another aspect, a method of forming an audio device includes: providing a housing; and connecting a handle assembly to the housing, the handle assembly including an eyelet in contact with the housing, a handle extending through at least a portion of the eyelet, an endpiece attached to an end of the handle, and a sealing member in contact with the eyelet and the housing.

Examples may include one of the above and/or below features, or any combination thereof.

In some examples, the handle assembly is connected to the housing by inserting an end of the eyelet into an opening in the housing, and then pressing the eyelet toward the center of the housing until the sealing member passes through the opening, thereby retaining the eyelet in the opening of the housing.

In some such examples, the endpiece is inserted into and rotated relative to an acoustic enclosure prior to inserting the end of the eyelet into the opening in the housing.

In some examples, the handle is placed through an opening in the eyelet prior to attaching the endpiece to the end of the handle.

In some examples, the endpiece of is attached to the handle by at least one of a retention member, adhesive, or bonding.

DETAILED DESCRIPTION

Figure 1:
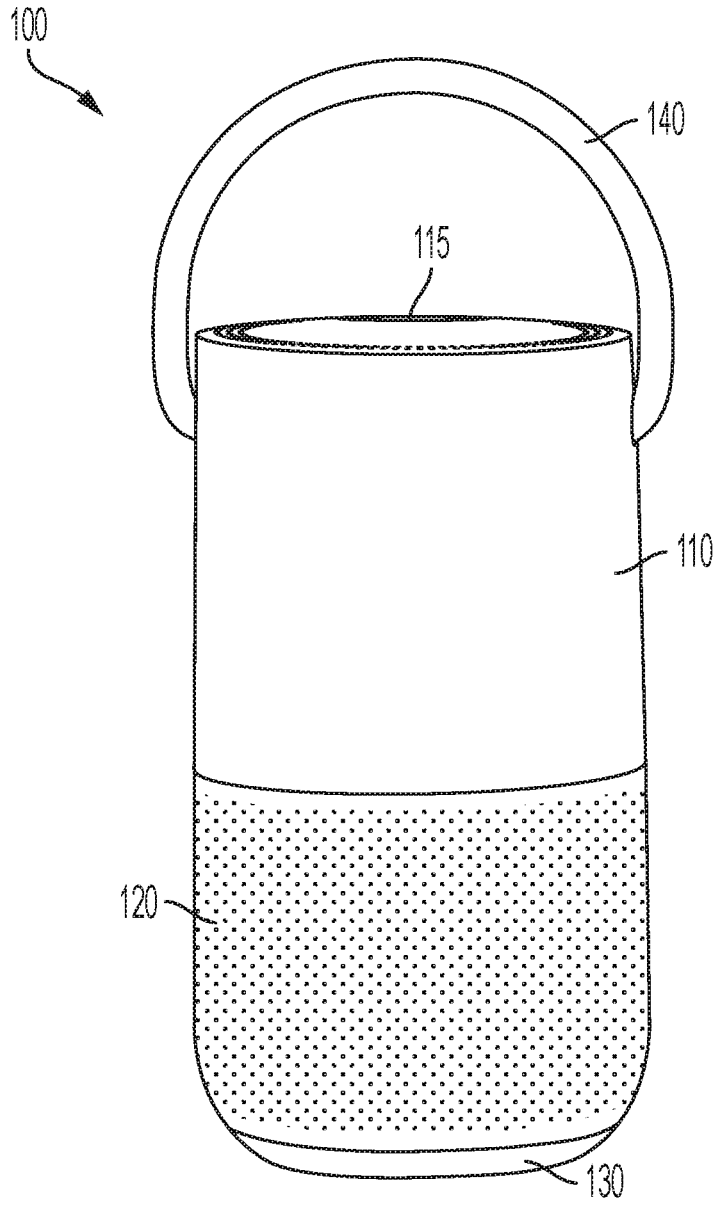
FIG. 1 illustrates a side perspective view of an audio device including a handle, according to various implementations.

As heavier electronic devices become portable, such as audio devices (e.g., loudspeakers), there is a nontrivial challenge related to how to carry those portable devices. This is particularly challenging as it is typically desired to decrease form factor size to promote portability, while maximizing the space inside the device housing for components of the device. For instance, for a loudspeaker, it is desirable to maximize the internal volume for the electro-acoustic driver(s), acoustic volume, battery, and other components, such as various printed circuit boards (PCBs). In such an instance, it is typically desirable to increase the size of the electro-acoustic driver(s) and/or acoustic volume to improve the loudspeaker output.

Thus, this disclosure describes an improved design for a handle assembly for an electronic device, such as an audio device. For example, in at least some implementations, the handle assembly includes a handle, such as a flexible fabric/rope handle, and parts on both ends of the handle to allow the handle to attach to the housing of the electronic device and/or to other components of the electronic device (e.g., to the internal acoustic enclosure of an audio device, as described herein). The parts on the ends of the handle include, in some implementations, an eyelet, a sealing member, and an endpiece, all of which are described in more detail herein.

The handle assembly as variously described herein provides numerous benefits. For instance, the handle assembly provides a robust attachment means for the electronic device (e.g., audio device) to which it is connected, which improves strength and durability, while providing other benefits. For example, each sealing member contacts its corresponding eyelet and the housing, thereby reducing or preventing acoustic buzz between the eyelet and the housing during playback of audio by the audio device. Each sealing member also helps provide shock absorption when the device is dropped (e.g., accidentally dropped from undesirably high heights). Further, the attachment assembly occupies a relatively small internal volume of the audio device, thereby maximizing the internal volume for other purposes (e.g., for acoustic volume). Thus, the handle assembly described herein is particularly well-suited for an audio device.

In addition, the handle assembly is easy to fit together and attach to an electronic device, such as an audio device, as the eyelets and sealing members for each end of the handle are slid onto the handle prior to attaching the endpieces on each end of the handle. For such an implementation, the endpieces are then inserted into openings in the housing of the corresponding audio device described herein to engage with the internal acoustic enclosure. The eyelets are then pressed into those openings, where the sealing members (e.g., O-rings) around each eyelet are pushed through the openings to secure the assembly in place on both ends of the handle, and effectively lock the handle to the housing of the audio device. Moreover, the simplicity of the handle assembly, including the use of available and inexpensive parts (e.g., readily-available O-rings), provides high manufacturability and low cost. Numerous other benefits will be apparent in light of this disclosure.

Note that although the electronic device primarily depicted/described herein is an audio device, and more specifically, a portable loudspeaker, the present disclosure is not intended to be so limited. For example, in some implementations, the handle assembly configurations described herein can be used for other electronic devices, including, but not limited to: portable computers, such as tablet and laptop computers; displays, such as monitors and televisions; portable lights and lanterns; and any other device that is portable and/or would benefit from a handle. Numerous configurations and variations will be apparent in light of this disclosure.

FIG. 1 illustrates a side perspective view of an audio device 100 including a handle 140, according to various implementations. In some cases, audio device 100 is a portable audio device such as a tabletop or handheld speaker that has capability for hard-wired and battery-powered operation. As shown in FIG. 1, audio device 100 includes upper enclosure 110, grille portion 120, external bottom cap 130, and handle 140. Together, upper enclosure 110, grille portion 120, and external bottom cap 130 provide the housing for audio device 100. However, other implementations could employ a housing with less or more parts, such as a single unitary housing, a housing with only lower and upper enclosures, or a housing with any number of parts.

In this implementation, audio device 100 is a portable loudspeaker device, including a rechargeable battery for power and capable of outputting sound via an electro-acoustic transducer. As audio device 100 is portable in this implementation, handle 140 is provided to help facilitate transport of the audio device 100. Handle 140 is attached using a handle assembly that is described in more detail below.

In some cases, upper enclosure 110, grille portion 120, and bottom cap 130 contain speaker components, such as one or more transducers (e.g., electro-acoustic transducers), resonators, digital signal processors (DSPs), and/or related control circuitry, as will be apparent in light of this disclosure. Grille portion 120 can include holes or openings to facilitate audio output from the speaker contained therein (such as is shown in FIG. 1). Upper enclosure 110 can include keypad 115 for actuating functions of the audio device 100, such as playback functions, volume control, device pairing, toggling connectivity (e.g., Wi-Fi or Bluetooth), and so forth. In some instances, keypad 115 includes one or more selectable keys, buttons, or other control features for interacting with the audio device 100 (e.g., to actuate the previously described functions). In some implementations, one or more portions of keypad 115 are illuminable. In some such implementations, keypad 115 includes a light ring and/or other lights that illuminate to provide various functions, such as to inform the user of a status or setting of the audio device (e.g., that the power is on or the battery is charging), for entertainment purposes (e.g., by syncing with audio output or to provide animations), for functional light output (e.g., as a night light or to identify the location of the speaker), and so forth.

Figure 2:
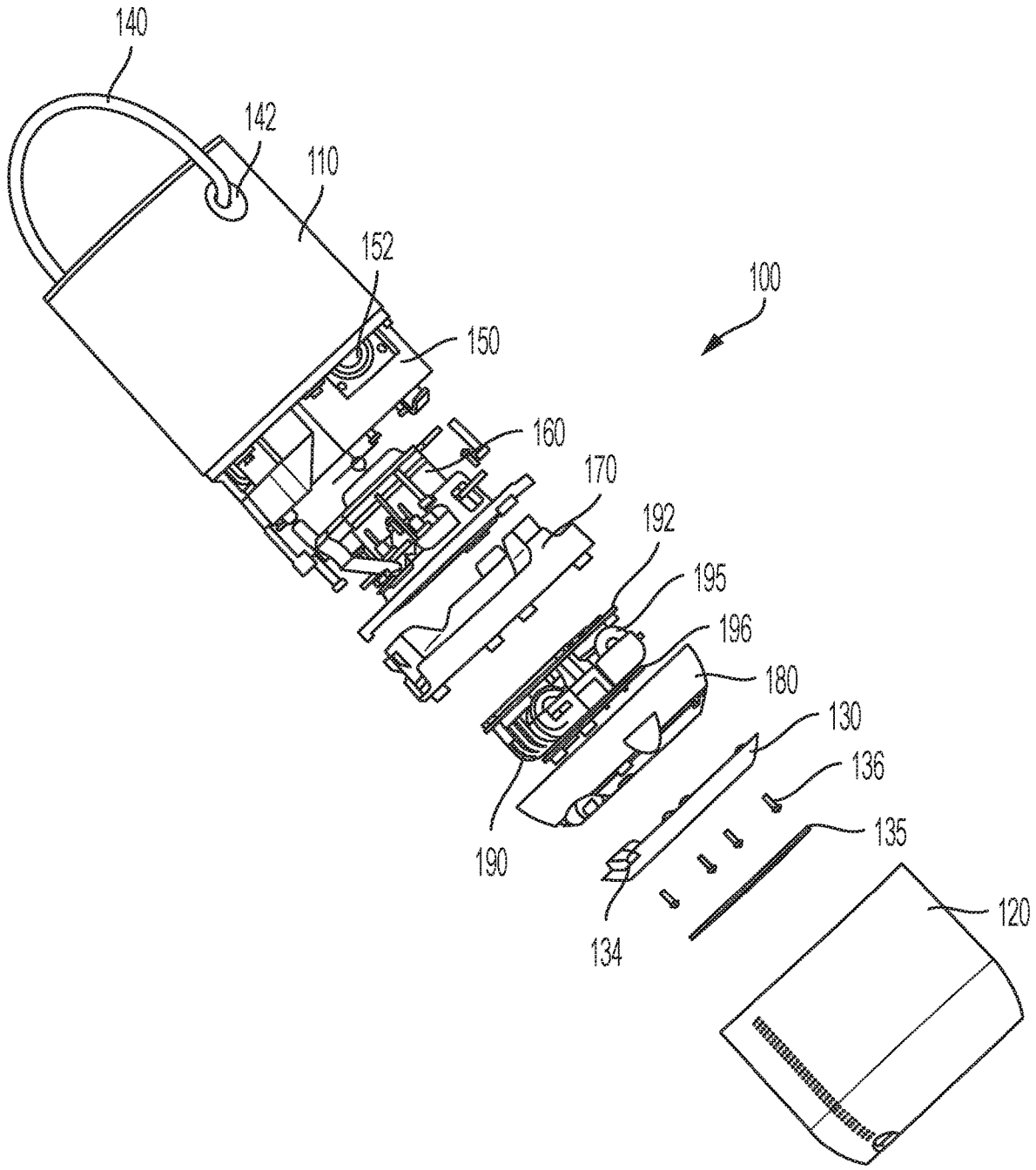
FIG. 2 illustrates an exploded view of the audio device of FIG. 1.

FIG. 2 illustrates an exploded view of audio device 100 of FIG. 1. The internal components of audio device 100 include acoustic enclosure 150, transducer or speaker 160, acoustic deflector 170, battery pack subassembly 190, and internal bottom cap 180. Internal bottom cap provides structural support for audio device 100. Audio device 100 also includes foot 135 which can provide a higher-friction resting surface for audio device 100 and/or assist with covering and providing access to fasteners (e.g., screws) 136, in this example implementation. In this implementation, external bottom cap 130 and fasteners 136 go on last to retain the grille portion 120 on the remainder of the audio device 100. However, in other implementations, foot 135 may be integral to another feature (e.g., external bottom cap 130) or may not be present at all. Note that the features of audio device 100 can be assembled using any suitable methods, such as utilizing screws (e.g., screws 136 and 156, as well as other screws shown in the figures) and/or other fasteners or methods of joining material (e.g., adhesives, friction/snap fit, soldering, etc.).

Battery pack subassembly 190, in some implementations, includes one or more batteries 195, and circuitry related to same, such as power management and recharging circuitry. The one or more batteries 195 can include any suitable rechargeable battery type and technology, such as those that utilize lithium-ion (or lithium-ion polymer), nickel (e.g., nickel metal hydride or nickel-cadmium), alkaline, lead acid, or other suitable chemistries. The battery-related circuitry can be distributed between one or more PCBs included in audio device 100, such as upper PCB 192, center PCB 194, and lower PCB 196, which are all included with battery pack subassembly 190. In this example implementation, upper PCB 192 is a power board and lower PCB 196 includes charging connectors for electrically charging the battery(ies) 195, as is described in more detail herein. Audio device 100 also includes charging port access 134 in external bottom cap 130 for accessing an alternative charging method, which includes being able to plug a cable connector (e.g., USB, such as USB-C) directly into the audio device 100 in this example implementation (as opposed to using the charging dock configuration described herein). However, in other implementations, such an alternative charging method need not be included or alternative/additional charging methods may be included.

Transducer or speaker 160 operates to produce sound, which travels through cavity 165 (between the speaker 160 and the acoustic deflector 170) and then through the holes in grille 120. Passive radiators 152 are arranged around, and seal slots within, the acoustic enclosure 150. In this implementation, three passive radiators 152 are employed; in other implementations, no passive radiators 152 or a different number of passive radiators (e.g., 1, 2, 4, or 5) can be employed. In some implementations, an acoustic port may be employed. As shown, speaker 160 fires downward, toward acoustic deflector 170 to provide omnidirectional sound. However, the present disclosure is not intended to be so limited, as other implementations may include more transducers and/or may direct sound in a directional manner. In some implementations, deflector 170 includes opening 175 which can facilitate a convective or airflow-based cooling effect to the battery pack subassembly 190 during operation of the speaker 160 (e.g., during audio playback). In other implementations, deflector 170 need not include any openings across from the speaker 160 (such that opening 175 is not present) or additional openings may be included.

Figure 3:
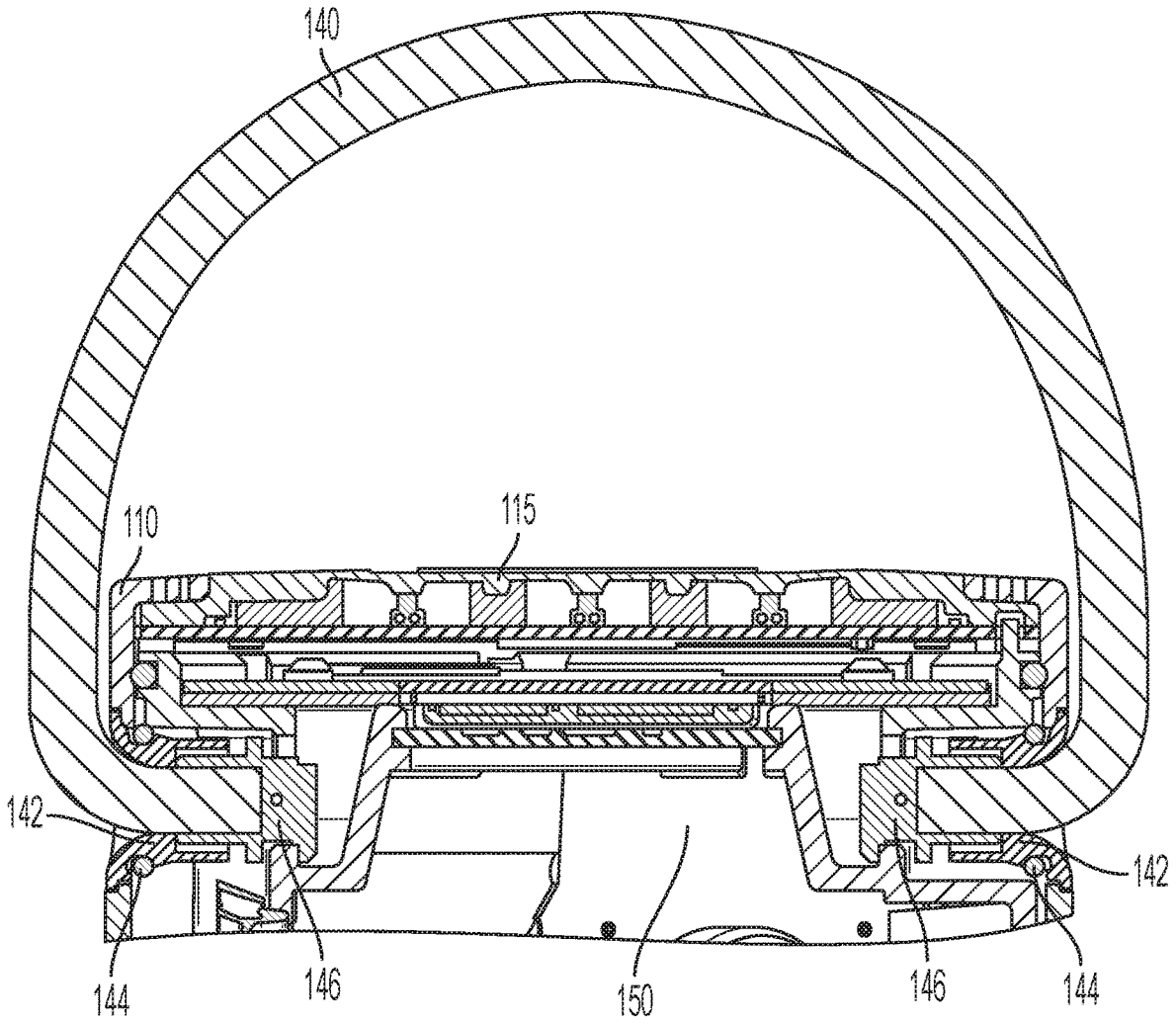
FIG. 3 illustrates a cross-sectional view of a handle assembly for the audio device of FIG. 1, in accordance with some aspects.
Figure 4:
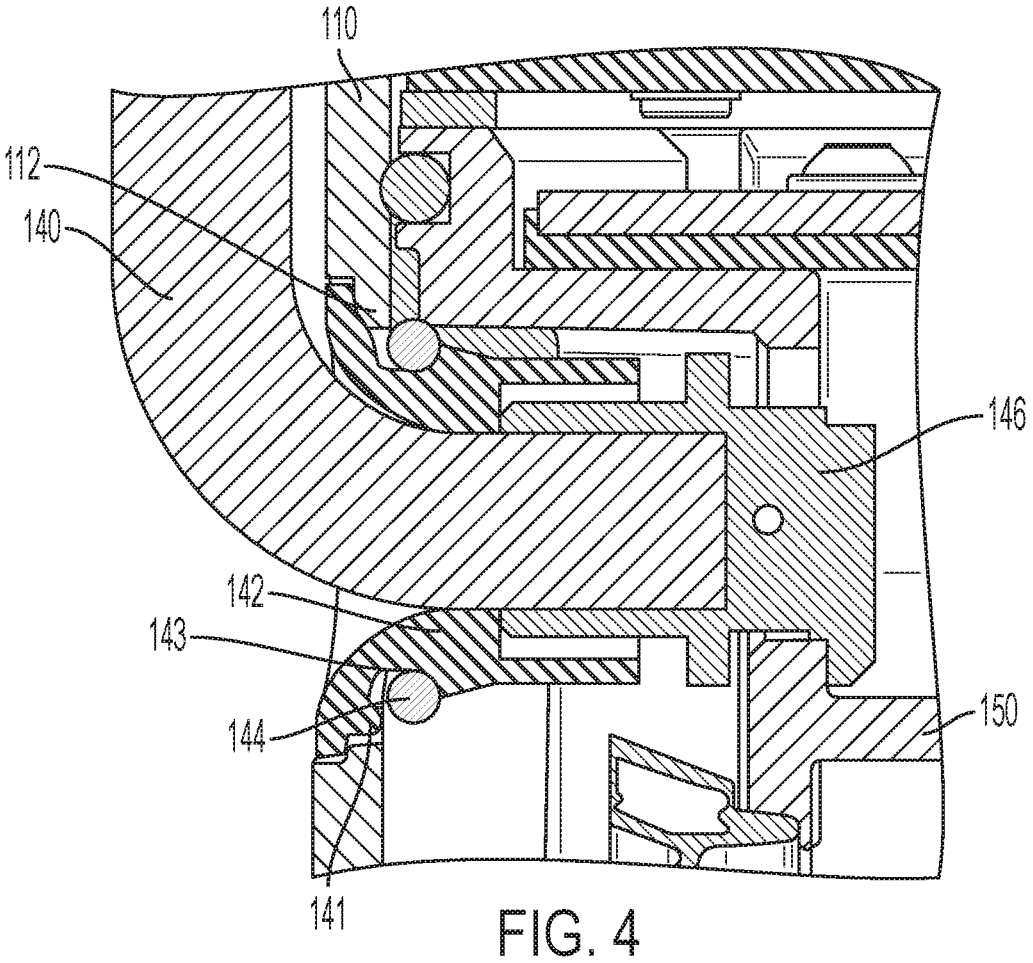
FIG. 4 is a blown-up portion of the view of FIG. 3, to help show the features of the handle assembly.
Figure 5:
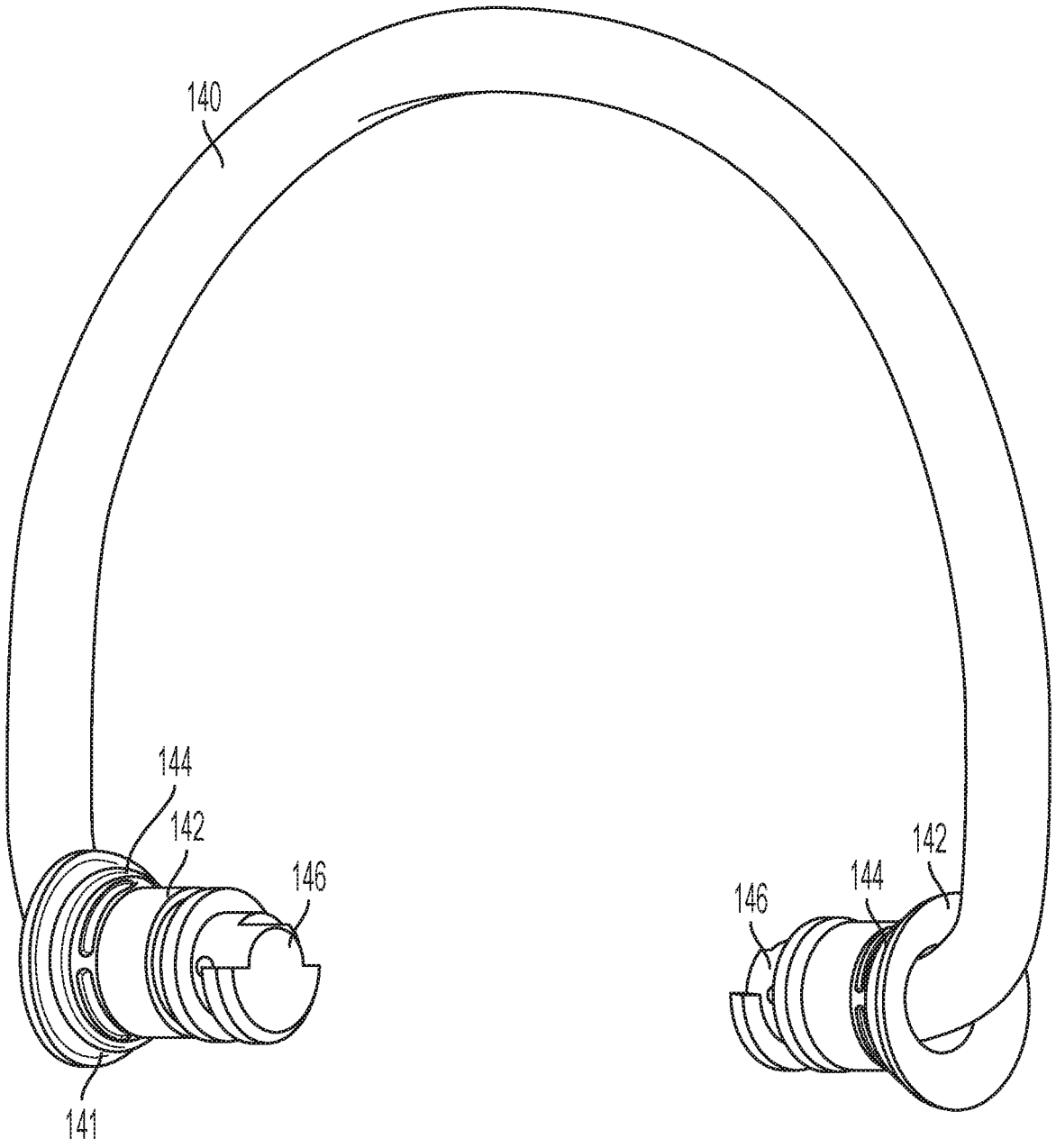
FIG. 5 illustrates only the handle assembly of the audio device of FIGS. 1-4, in accordance with some aspects.
Figure 6:
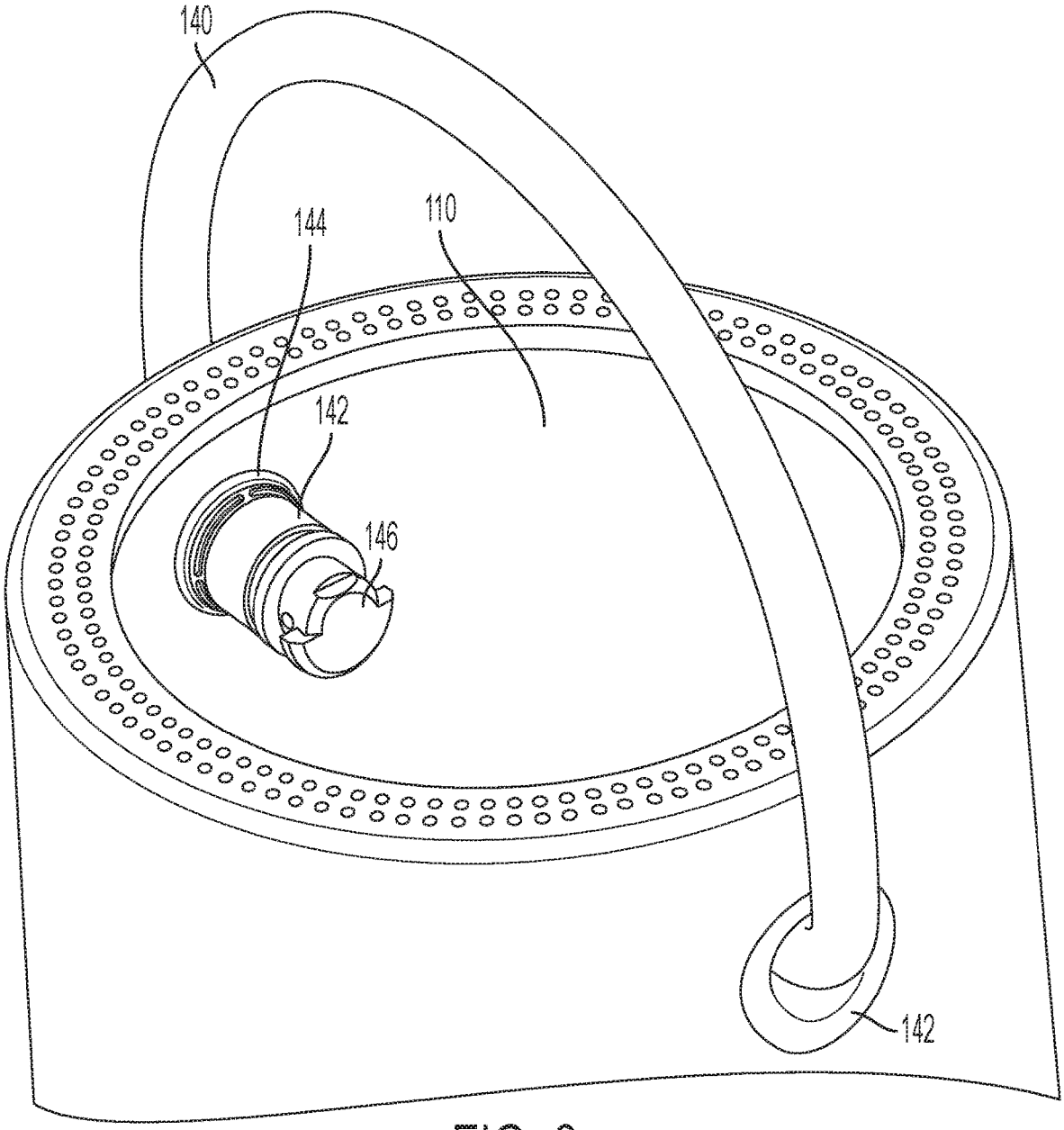
FIG. 6 illustrates the handle assembly and upper enclosure of the housing of the audio device of FIGS. 1-4, in accordance with some aspects.

FIGS. 3 and 4 illustrate cross-sectional views of a handle assembly in accordance with some aspects. As can be understood, FIG. 4 is a blown-up portion of the view of FIG. 3, to help show the features of the handle assembly described herein. FIG. 5 illustrates only the handle assembly of audio device 100 of FIGS. 1-4, in accordance with some aspects. FIG. 6 illustrates the handle assembly and upper enclosure 110 of the housing of audio device 100 of FIGS. 1-4, in accordance with some aspects. In this implementation, handle assembly includes handle 140, eyelet 142, sealing member 144, and endpiece 146. Handle 140 can be constructed of plastic, glass, metal, wood, various fabrics, or any other suitable material. In this example implementation, handle 140 is constructed of fabric (e.g., a flexible fabric rope) having two ends. In some implementations, handle 140 could include multiple layers. In addition, the shape of handle 140 need not be limited to what is shown, as a handle employing three or more ends could be used, or a handle having a different shape than what is shown in the figures.

In this example implementation, the handle assembly is prepared by sliding eyelet 142 onto an end of handle 140, where sealing member 144 is inserted into groove 143 in eyelet 142 (groove 143 indicated in FIG. 4). Groove 143 is optional, but in this implementation, it goes around the entirety of eyelet 142 to secure sealing member 144 to eyelet 142. Endpiece 146 is attached to the end of handle 140 to secure the endpiece 146 and eyelet 142 onto that end of the handle. The same process can be repeated for the other end of handle 140. Endpiece 146 can be attached using any suitable coupling means, such as using at least one of a retention member (e.g., a pin through endpiece 146 and the end of handle 140), adhesive, or bonding, to provide some examples. In other implementations, one or both of the endpieces 146 are integral to handle 140. For instance, if one of the endpieces 146 was integral to handle 140, then eyelets 142 could still slide onto handle 140 via the other end of handle 140.

The handle assembly is attached to the remainder of audio device 100 by inserting an end of the handle 140 with an endpiece 146 in an opening in the housing of the audio device 100, and more specifically in this example implementation, in an opening in the upper enclosure 110 of the housing of the audio device 100. Endpiece 146 is inserted through the opening in upper enclosure 110, and into an opening in the acoustic enclosure 150, which is inside of the housing as shown. Handle 140 can be twisted to lock or otherwise engage endpiece 146 with acoustic enclosure 150, as shown in FIG. 4. This process can be done for both sides simultaneously to engage both of the endpieces 146 with acoustic enclosure 150. However, such an engagement provides an optional backup or additional mechanism for securing the handle assembly to the housing of the acoustic device 100, as the handle assembly is also secured to the housing using sealing member 144, as is described in more detail below. Note that in this example implementation, handle 140 includes pre-forming that makes it difficult to twist handle 140 to a point where endpieces 146 disengage with acoustic enclosure 150, but such a configuration need not be employed, as eyelets 142 secure endpiece 146 inside of upper enclosure 110, as is described in more detail below.

In this example implementation, after endpieces 146 have been engaged with acoustic enclosure 150, eyelets 142 can be pressed through their respective openings in upper enclosure 110 such that sealing members 144 pass through the opening to secure the eyelets 142 to the housing as shown in FIGS. 3, 4, and 6. As is also shown, each endpiece 146 is secured in the housing due to contact with the corresponding eyelet 142. This configuration provides flexibility in the attachment/installation process, as the required tolerances of the eyelet 142, housing opening, and sealing member 144 can be increased due to the ability of sealing member 144 to compress when pushed through the housing opening. Once sealing members 144 are pressed through the corresponding openings in the upper enclosure 110, in this implementation, it is very difficult to remove the eyelets 142, especially without using a tool. Thus, each sealing member 144 effectively prevents (e.g., without using considerable force or a tool) its corresponding eyelet 142 from disconnecting from the housing.

The sealing member 144 on each side of the handle assembly is in contact with its corresponding eyelet 142 (specifically, sitting in groove 143 in this example implementation) and the housing of the audio device (specifically, upper enclosure 110 in this example implementation). This helps to prevent (or at least reduce) acoustic buzz that would otherwise occur between each of the eyelets 142 and the housing (upper enclosure 110, in this example) during audio playback. Sealing member can also help prevent (or at least reduce) acoustic buzz that would otherwise occur between acoustic enclosure 150 and one or both of eyelets 142 or the housing (upper enclosure 110, in this example). In addition, the sealing member provides other benefits, such as ingress protection (e.g., from solid particles, such as dust, and liquids, such as water) and drop protection (e.g., providing material that better absorbs impact), to provide some additional examples.

Further, when handle assembly is attached, the outer surface of eyelet 142 is flush with the outer surface of the housing (specifically, upper enclosure 110 in this example implementation). This is enabled by the lip portion 112 of upper enclosure 110 that extends into the opening in which the handle assembly is inserted. Thus, the combined thickness (in a horizontal plane) of the lip portion 112 and the adjacent portion of eyelet 142 is the same as (or substantially the same as, within 5%) the thickness of a nearby portion of the upper enclosure 110. The flush appearance of the eyelet 142 and the housing provides a seamless design that is visually appealing.

Eyelets 142 can be constructed of plastic, metal, wood, or any other suitable material. In this example implementation, eyelets 142 are plastic, and are formed by injection molding. Sealing members 144 can be constructed of rubber, silicone, or any other suitable elastomer. In this example implementation, eyelets 142 are rubber O-rings. In some implementations, the sealing member 144 is integral with eyelet 142, which could be achieved, e.g., using a multi-material formation process to provide different durometers for the eyelet portion and sealing member portion of the integral part. Endpieces 146 can be constructed of plastic, metal, wood, or any other suitable material. In this example implementation, endpieces 146 are constructed of plastic, and they are bonded to the ends of handle 140.

An optional feature for eyelets 142 that is employed in this implementation is the use of a rotational inhibitor that reduces or prevents eyelets 142 from rotating around handle 140 when attached to the housing of audio device 100. For instance, as indicated in FIGS. 4 and 5, eyelet 142 includes first mating structure that is configured to engage with a second mating structure on the upper enclosure 110 portion of the housing. In this example implementation, eyelet 142 includes a tooth 141 that engages with a notch in upper enclosure 110. However, in other implementations, eyelet 142 could include a notch that engages with a tooth or protrusion of upper enclosure 110. Numerous other first and second mating structures could be employed to prevent or at least reduce eyelet 142 from rotating around handle when attached to the housing of audio device 100, such as utilizing a pin/peg and hole configuration, where the pin/peg need not be integral to either of the eyelet 142 or the housing (e.g., upper enclosure 110), to provide another example.

It is understood that the relative proportions, sizes, and shapes of the audio device 100 and handle assembly as shown in the figures are merely illustrative of such physical attributes of these components. That is, these proportions, shapes, and sizes can be modified according to various implementations to fit a variety of products. For example, while a substantially tubular (or circular cross-sectional) shaped loudspeaker is shown according to particular implementations, it is understood that the loudspeaker could also take on other three-dimensional shapes in order to provide acoustic functions described herein.

In various implementations, components described as being "coupled" to one another can be joined along one or more interfaces. In some implementations, these interfaces can include junctions between distinct components, and in other cases, these interfaces can include a solidly and/or integrally formed interconnection. That is, in some cases, components that are "coupled" to one another can be simultaneously formed to define a single continuous member (i.e., integrally formed). In other implementations, these coupled components can be formed as separate members and be subsequently joined through known processes (e.g., soldering, fastening, ultrasonic welding, bonding). In various implementations, electronic components described as being "coupled" can be linked via conventional hard-wired and/or wireless means such that these electronic components can communicate electricity and/or data with one another. Additionally, sub-components within a given component can be considered to be linked via conventional pathways, which may not necessarily be illustrated.

A number of implementations have been described. Nevertheless, it will be understood that additional modifications may be made without departing from the scope of the subject matter described herein, and, accordingly, other implementations are within the scope of the following claims.

What is claimed is:

1. An audio device comprising:

a housing; and a handle assembly connected to the housing, the handle assembly including an eyelet in contact with the housing, a handle extending through at least a portion of the eyelet, an endpiece attached to an end of the handle, wherein the endpiece is secured in the housing, and a sealing member in contact with the eyelet and the housing, wherein the sealing member provides ingress protection.

2. The audio device of claim 1, wherein the sealing member forces the eyelet and the housing together at a location where the eyelet is in contact with the housing.

3. The audio device of claim 1, wherein the sealing member effectively prevents the eyelet from disconnecting from the housing.

4. The audio device of claim 1, wherein the sealing member reduces the handle assembly from causing undesired acoustic buzz during playback.

5. The audio device of claim 1, wherein the sealing member is an O-ring.

6. The audio device of claim 1, wherein the sealing member sits in a groove in the eyelet.

7. The audio device of claim 1, wherein a portion of the endpiece sits in a portion of the eyelet, such that the portion of the eyelet surrounds the portion of the endpiece.

8. The audio device of claim 1, wherein the eyelet is in contact with the housing at a lip of the housing, such that an outside surface of the eyelet is flush with an outside surface of the housing.

9. The audio device of claim 1, further comprising an acoustic enclosure, wherein the endpiece is rotatably engaged with the acoustic enclosure.

10. The audio device of claim 1, wherein one of the eyelet or the housing includes a first mating structure that engages with a second mating structure of the other of the eyelet or the housing to prevent rotation of the eyelet relative to the acoustic enclosure.

11. The audio device of claim 10, wherein the first mating structure is a tooth and the second mating structure is a notch.

12. The audio device of claim 1, wherein the handle is constructed of fabric.

13. The audio device of claim 1, wherein the endpiece is integral with the handle.

14. The audio device of claim 1, wherein the handle assembly further comprises another eyelet in contact with the housing, the handle extending through at least a portion of the other eyelet, another endpiece attached to the other end of the handle, and another sealing member in contact with the other eyelet and the housing.

15. The audio device of claim 1, further comprising one or more electro-acoustic drivers within the housing.

16. A method of forming an audio device, the method comprising:

providing a housing; and connecting a handle assembly to the housing, the handle assembly including an eyelet in contact with the housing, a handle extending through at least a portion of the eyelet, an endpiece attached to an end of the handle, wherein the endpiece is secured in the housing, and a sealing member in contact with the eyelet and the housing, wherein the sealing member provides ingress protection.

17. The method of claim 16, wherein the handle assembly is connected to the housing by inserting an end of the eyelet into an opening in the housing, and then pressing the eyelet toward the center of the housing until the sealing member passes through the opening, thereby retaining the eyelet in the opening of the housing.

18. The method of claim 17, wherein the endpiece is inserted into and rotated relative to an acoustic enclosure prior to inserting the end of the eyelet into the opening in the housing.

19. The method of claim 16, wherein the handle is placed through an opening in the eyelet prior to attaching the endpiece to the end of the handle.

20. The method of claim 16, wherein the endpiece of is attached to the handle by at least one of a retention member, adhesive, or bonding.

* * * * *